US005754996A

United States Patent [19]

VanSwearingen

[11] Patent Number: 5,754,996

[45] Date of Patent: May 26, 1998

[54] PORTABLE BEDCLOTHES STORAGE DEVICE

[76] Inventor: Joseph B. VanSwearingen, 1006 Chambers La., Mt. Pleasant, S.C. 29464

[21] Appl. No.: 637,851

[22] Filed: Apr. 25, 1996

[51] Int. Cl.[6] ..... A47C 21/02

[52] U.S. Cl. ..... 5/504.1; 5/503.1; 5/506.1

[58] Field of Search ..... 5/504.1, 505.1, 5/506.1, 658, 503.1, 308, 58; 248/96, 97

[56] References Cited

U.S. PATENT DOCUMENTS

| | | | |
|---|---|---|---|
| 1,002,147 | 8/1911 | Harris | 248/455 |
| 1,067,060 | 7/1913 | Pierce | 5/504.1 |
| 1,262,086 | 4/1918 | Paige | 5/504.1 |
| 2,041,017 | 5/1936 | Pennington | 248/455 |
| 2,632,899 | 3/1953 | Logan | 5/504.1 |
| 3,193,240 | 7/1965 | Browett | 248/449 |
| 3,198,475 | 8/1965 | Flahive | 248/449 |
| 4,404,914 | 9/1983 | Taylor | 248/449 |
| 4,620,682 | 11/1986 | Yim | 248/96 |
| 4,718,630 | 1/1988 | Richard | 248/445 |
| 5,129,616 | 7/1992 | Carson | 248/445 |
| 5,209,350 | 5/1993 | Maeng | 248/96 |
| 5,464,180 | 11/1995 | Cheng | 248/96 |

*Primary Examiner*—Steven N. Meyers
*Assistant Examiner*—Tuyet-Phuong Pham
*Attorney, Agent, or Firm*—Dallis Law Firm, P.A.

[57] ABSTRACT

A bed accessory for the efficient and organized daily storage and retrieval of bedclothes defined by a symmetrically undulating bedclothes storage surface supported by an adjustable wedge assembly and stabilizing leg assembly. When the bedclothes storage surface is pulled from beneath a bed and rotated upward into an erected position, the adjustable wedge assembly, remaining beneath the bed, becomes compressed between the floor and the under surface of the bed, as adjustable stabilizing legs, located on the reverse side, rotate to a position of support. After use, a moderate down and in force applied to the upper edge of the bedclothes storage surface causes the adjustable wedge and stabilizing leg assemblies to rotate to a stowed position for reinsertion of the apparatus beneath the bed.

19 Claims, 4 Drawing Sheets

PORTABLE BEDCLOTHES STORAGE DEVICE

BACKGROUND OF THE INVENTION

1. Field of the Invention

The present invention relates to the field of bedclothes holders and rack devices and, more particularly, to a unique device to be temporarily secured to the undersurface of a standard bed foundation and, after being used to receive and hold bedclothes, to be unobtrusively stowed beneath a standard bed.

2. Description of the Related Art

The daily effort of making a bed can become a frustrating and time consuming chore, because items of bedclothes must be removed, temporarily stored, then rearranged in proper sequence and placement. Since the surfaces of adjoining furniture are normally in use, a bedclothes storage device or rack alleviates the frustration of finding an unused storage space and of folding and unfolding bedclothes, continually searching for the appropriate edges. Most devices used to store bedclothes are free standing or rest between the mattress and foundation of a standard bed. Although existing designs are simple in their construction and relatively easy to use, they often take up desirable space when not being used. Some bedclothes holders incorporate folding or slide away features in their design, but none compare with the convenience, stowing ease and time saving aspect of the present invention.

The relevant prior art in the field of bedclothes stands and storage devices includes U.S. Pat. No. 1,186,032 to Peele. The Peele invention is described as a light frame with top mounted diagonally intersecting members to store bedclothes. After unfolding and positioning for use, the frame must be refolded and stowed away. Although portable, the Peele invention exhibits inadequate load bearing characteristics and appears troublesome in set-up and use.

U.S. Pat. No. Des. 273,643 to Sanker et al. discloses a slidable bedclothes rack for insertion between a mattress and box spring. The Sanker device consists of a simple rack that is pulled out from between the mattress and box spring. The rack operates as a shelf to hold the bedclothes. The Sanker rack design displays minimal load bearing ability as evidenced by its size and method of retention. During withdrawal from beneath a mattress the device would likely dislodge neatly arranged bedclothes and is limited for use to beds without a mattress covering footboard.

U.S. Pat. No. Des. 353,847 to Station discloses a bedclothes storage device comprising a vertical rack attached to a horizontal rack at right angles. The exact operation of the Station invention is not obvious, however, the design is quite simple. It may be a free-standing rack or one side may be inserted between a mattress and box spring, similar to the Sanker device.

In each of the prior art examples provided, manipulation of the device requires significant additional mechanical or ergonomic effort to effect the bed making process. The instant invention, designed to accept today's larger blankets and comforters may be secured to any edge of a standard bed, requires little effort to use and less to replace beneath a bed.

SUMMARY OF THE INVENTION

It is therefore an objective of this invention to provide a portable storage device for the efficient and organized daily repositioning and retrieval of bedclothes, in a convenient and timely manner, during the various phases of preparation related to the use of a bed.

It is further an objective of this invention to provide an ergonomically designed device that is quickly and easily positioned to receive and hold bedclothes during periods of need and to easily adjust for placement beneath a bed.

It is still further an objective of this invention to provide a stable and reliable structure of a size and dimension to effectively receive and hold large blankets and comforters for temporary or continuous periods of time as desired by the user.

These as well as other objectives are accomplished by a portable bedclothes storage device, designed to be an adjunctive accessory for a standard bed or similar structure that can provide an elevated upper mounting plane in reference to a lower mounting plane, in this application, exemplified by a floor. The bedclothes storage device is comprised of a bedclothes storage surface, compatible in width to the breadth of a bed or structure that is to form a mounting base for its use, projecting upward at an approximate forty five degree angle with reference to the lower mounting plane of the floor at the base of a bed or similar elevated structure, forming a containment or support surface of maximum storage capacity, yet minimum linear extension, between the storage surface of the device and the vertical facing of the structure under which the device has been mounted. In the present example, decorative and personnel pillows are stored within the containment of bedclothes storage surface and the horizontal bar defining the top of the storage device is used to drape or fold a bedspread, blanket or sheets over the bedclothes storage surface structure with the outer edges readily available for replacement over a bed.

The portable bedclothes storage device is transformable in configuration to meet multiple objectives; to provide a stabilized storage surface for bedclothes, to lie flat on the reverse side and to be of minimum height for stowage beneath a bed, and to be capable of a stand-alone configuration by resting on an end surface, during which the bedclothes storage surface projects upward.

The portable bedclothes storage device comprises of multiple subassemblies; an adjustable wedge assembly, the bedclothes storage surface and the adjustable stabilizing leg assemblies. The purpose of the adjustable wedge assembly is to anchor a horizontally arranged, rectangular, tubular, box-like structure, equal in width to the bedclothes storage surface, between a floor and the under surface of a bed as the device is drawn forth from beneath a bed and rotated upward to an erected angular position. The wedging function is achieved because, while lying flat, the device fits beneath a bed, but when rotated upward, the hypotenuse of the cross section of the rectangular box-like adjustable wedge assembly is greater in length than the distance between a floor and the under surface of a bed. The bedclothes storage surface, a sheeting of sturdy, resilient material, is adhered within and follows the contour of the undulating support frame that is assembled to and projects from the adjustable wedge assembly and in the preferred embodiment displays an undulating surface to maximize the bedclothes storage surface and to provide a shelving feature for the receipt of pillows. The adjustable stabilizing leg assemblies, located on the reverse, or non-loading side of the bedclothes storage surface, comprises freely rotating and adjustable stabilizing legs that operate to rotate, through the force of gravity, to a mechanically established position of support and there to act as a fulcrum for the cantilevered bedclothes storage surface and to rotate, in response to an inward and down thrust applied to the device, to a counter position, there to lie flat against the reverse side of the device and lastly to be manually placed in a position of maximum counter rotation, in the stand-alone configuration.

Although the height of well-made bed frames available from leading department stores is seven and one-half inches, measured from the surface of a floor to the bed support rails, the wedge assembly and stabilizing leg assemblies are adjustable to accommodate the varying heights of bed foundations or similar elevated structure.

The present invention, when not in use, lies on the reverse, or non-loading side beneath a bed. For use to store bedclothes, a top positioning bar of the device is grasped and the device is drawn forth from beneath a bed, or similar elevated structure, to an extent and in an alignment provided by a bed footboard or specially provided alignment guides. During the withdrawal action the top positioning bar is rotated upward causing the wedge assembly to become compressed beneath an elevated upper mounting plane and the stabilizing legs to drop into a support position, there to function as a fulcrum for the cantilevered load bearing surface now projecting upward at a forty-five degree angle with reference to the lower mounting plane or floor surface. A moderate inward and down thrust applied to the top positioning bar results in the release of the wedge assembly and a counter rotation of the stabilizing legs as the legs rotate to lie loose within the confines of the reverse side of the device in a position that allows the portable bedclothes storage device to again be replaced beneath the elevated upper mounting plane or a bed.

BRIEF DESCRIPTION OF THE DRAWINGS

A preferred embodiment of the present invention is described herein with reference to the drawings wherein.

DETAILED DESCRIPTION OF THE PREFERRED EMBODIMENT

Figures 1, 1A:
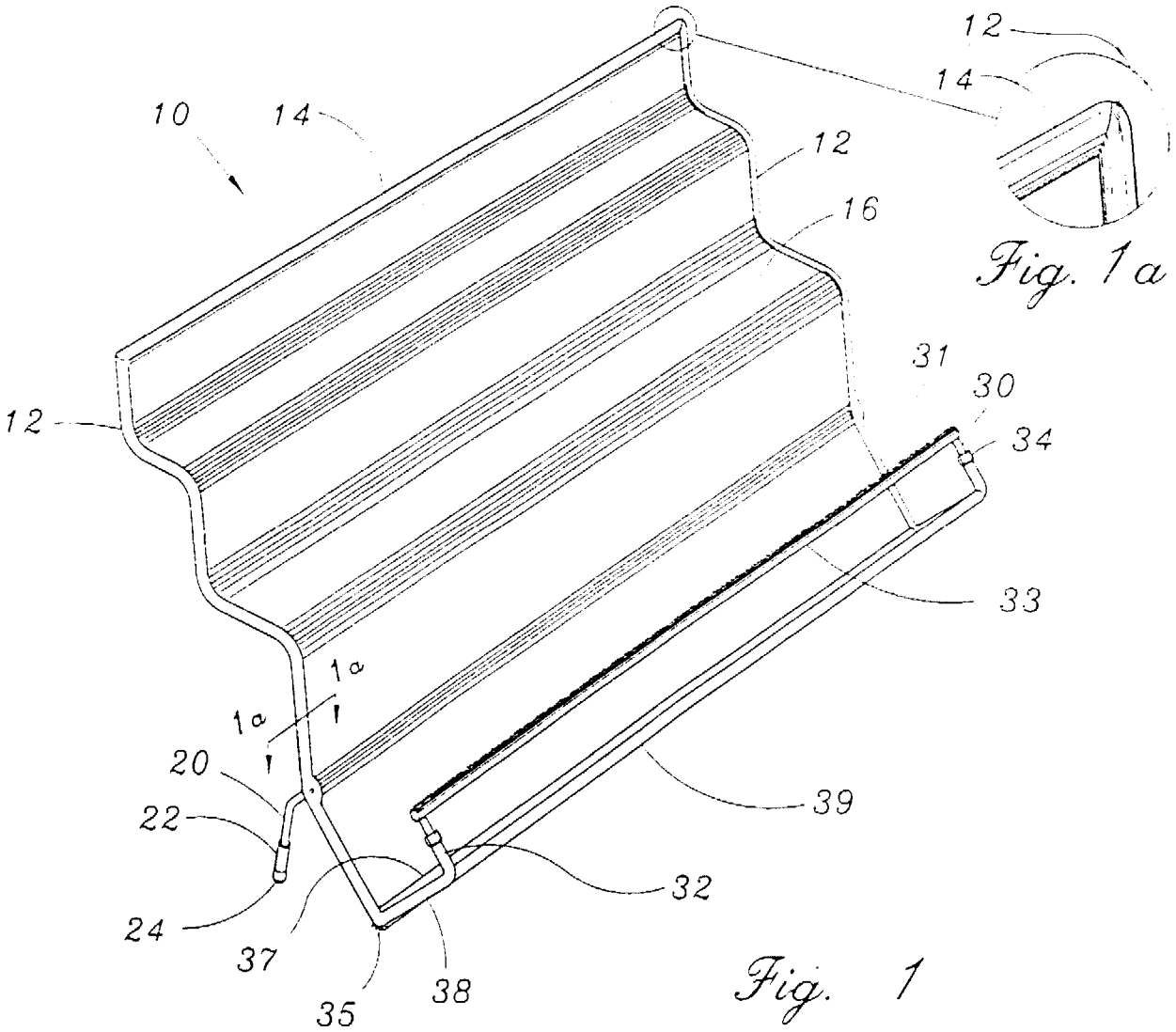
FIG. 1 of the drawings is a perspective view of the present invention showing the device oriented for use in storing bedclothes.
FIG. 1*a* of the drawings is an exploded view of the corner of the bedclothes storage device showing union of the perimeter bars of the support frame.

Referring to the drawings by numerals of reference, there is shown in FIGS. 1, 2, 3 and 4 the portable bedclothes storage device (10). This portable bedclothes storage device (10) comprises a bedclothes storage surface (16) which is supported in an upright position from the rear by a first and second adjustable stabilizing leg (20) and by an adjustable wedge assembly including an upper compression bar (33) designed to be wedged against the underside edge of a standard bed foundation (40).

Referring to FIG. 1, the various elements of the portable bedclothes storage device are presented. The bedclothes storage surface (16) is supported by a support frame comprising a first and second side support bar (12), a top positioning bar (14), and a lower compression bar (37). The frame as shown in FIG. 1 detailed in FIG. 1*b* of the bedclothes storage device is of sufficient diameter and wall thickness as to support anticipated storage loads and to accommodate the installation of dynamic components. The bedclothes storage frame and surface (16) is designed with an undulating configuration to both maximize usable surface area and to hold bedclothes in position while making a bed. The adjustable wedge assembly of the portable bedclothes storage device (10) includes an adjustable upper compression bar (33), a lower compression bar (37), a compression pivot bar (39) and a first and second bottom wedge frame (38) extending orthogonally from both first and second side support bars (12). The basic adjustable stabilizing leg assembly, of exact placement and angular relationship, includes a first and second stabilizing leg (20) as previously defined, pivoted within the reverse side of the first and second side support bars (12).

Figure 2B:
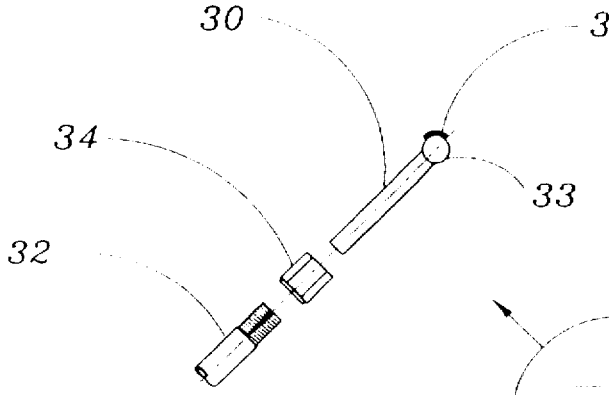
FIG. 2*b* of the drawings is break-away view of the components making up the split socket connection of the adjustable wedge assembly.
Figure 2A:
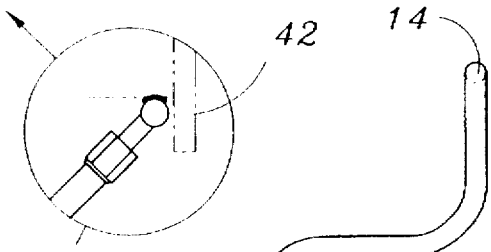
FIG. 2*a* of the drawings is an exploded view of the upper compression bar as it presses against an elevated horizontal plane.
Figure 2:
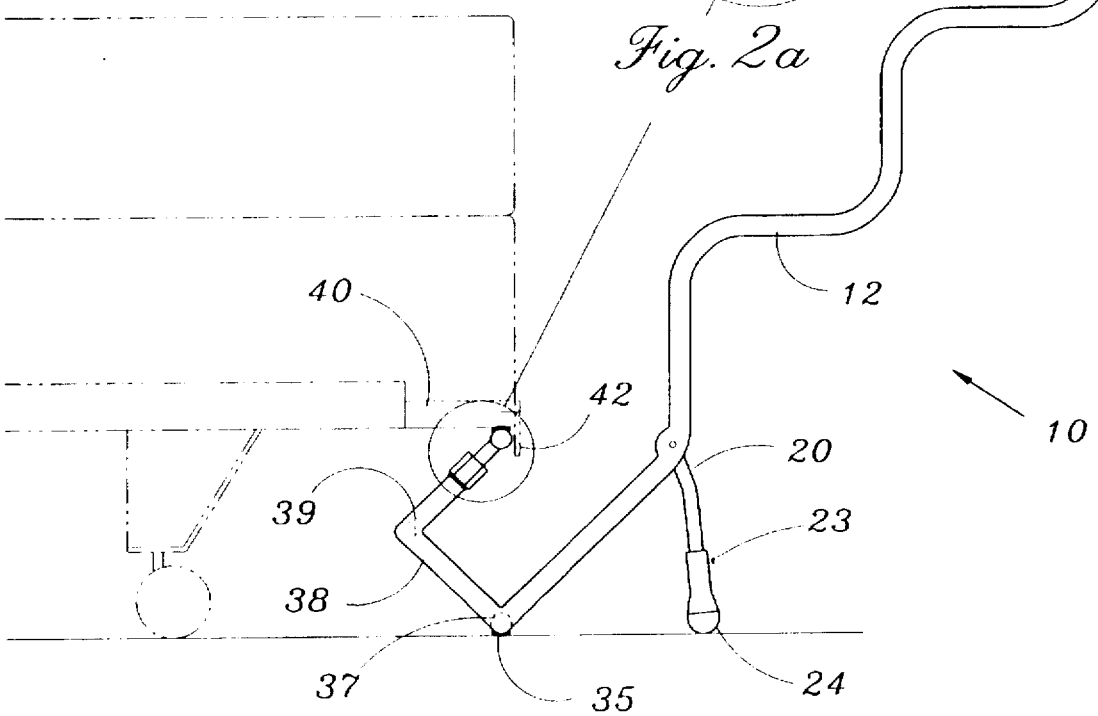
FIG. 2 of the drawings is a side view of the securing means of the present invention to the underside edge of a standard bed frame or bed foundation.

Referring to FIGS. 2, 2*a* and 2*b* which is a side view of the structure of a standard bed without a footboard, showing the operation of the securing mechanism of the portable bedclothes storage device (10) as it is erected at the foot of a bed. Manual positioning is effected by grasping a top positioning bar (14) as the device, previously lying flat and concealed beneath the bed foundation (40), is pulled forth and lifted upward. As the portable bedclothes storage device (10) is pulled from beneath the bed foundation (40), the upper compression bar (33) comes in contact with the first and second alignment guides (42), installed equidistant from each side edge of the bed foundation (40), to limit and align the withdrawal motion. Upon achieving alignment, the bedclothes storage surface's top positioning bar (14) is lifted upward causing the upper compression pad (31) and upper compression bar (33) to become wedged against an elevated upper mounting plane exemplified by the under-structure of the bed foundation (40) and to form a point of pivot as the lower compression pad (35) and lower compression bar (37) rotate to a compressed position against the lower mounting plane exemplified by the floor, while flexing about the compression pivot bar (39). The upper compression pad (31) and lower compression pad (35) are horizontally splined rubberized pads provided to protect outward compression surfaces and to enhance the wedging function. When the bedclothes storage surface (16) is lifted slightly past a forty five degree angle from horizontal, which naturally occurs, the first and second adjustable stabilizing legs (20) drop to a mechanically limited position. A further downward break in the longitudinal axis of the adjustable stabilizing legs (20) accomplishes two objectives; to provide a stabilized point of fulcrum for load bearing support and to provide the optimum angular relationship for transition to the stowed position. Once the first and second adjustable stabilizing legs (20) have dropped to position, release of the upper position bar (14) allows the portable bedclothes storage device (10) to settle into position, ready for use in storing bed clothing.

Continuing with FIG. 2, to stow the portable bedclothes storage device (10) beneath the bed, a moderate inward and down thrust on the upper positioning bar (14) releases the compressed grip of the lower compression pad (35) and the lower compression bar (37) allowing a counter rotation of the wedge assembly in coincidence with a counter rotation of the adjustable stabilizing legs (20). During the stowage process and as the adjustable stabilizing legs (20) commence their reverse rotation, a slight rise of the portable bedclothes storage device (10) will occur because of the positive attitude of the adjustable stabilizing legs (20) with regard to the vertical. The rise, having no effect on operation, is quickly passed as the adjustable stabilizing legs (20) rotate to the stowed position as portrayed by FIG. 4.

Continuing with reference to FIG. 2, to accommodate varying dimension between the upper and lower mounting planes, plus or minus one inch of adjustment is provided in form of the adjustable stabilizing legs (20) and an adjustable upper compression bar (33). The details of the adjustable wedge assembly and upper compression bar (33) are forthwith presented. The adjustable wedge assembly is comprised of a split socket (32), a tapered cinch nut (34) and an adjustable tube (30). The upper compression bar (33) can be extended or retracted by using the tapered cinch nut (34) to adjust the first and second adjustable tube (30) up or down inside the split socket (32) to establish effective wedging of the upper compression pad (31) against the elevated upper mounting plane, in the depicted application, a bed foundation (40).

Figures 3, 3A, 3B:
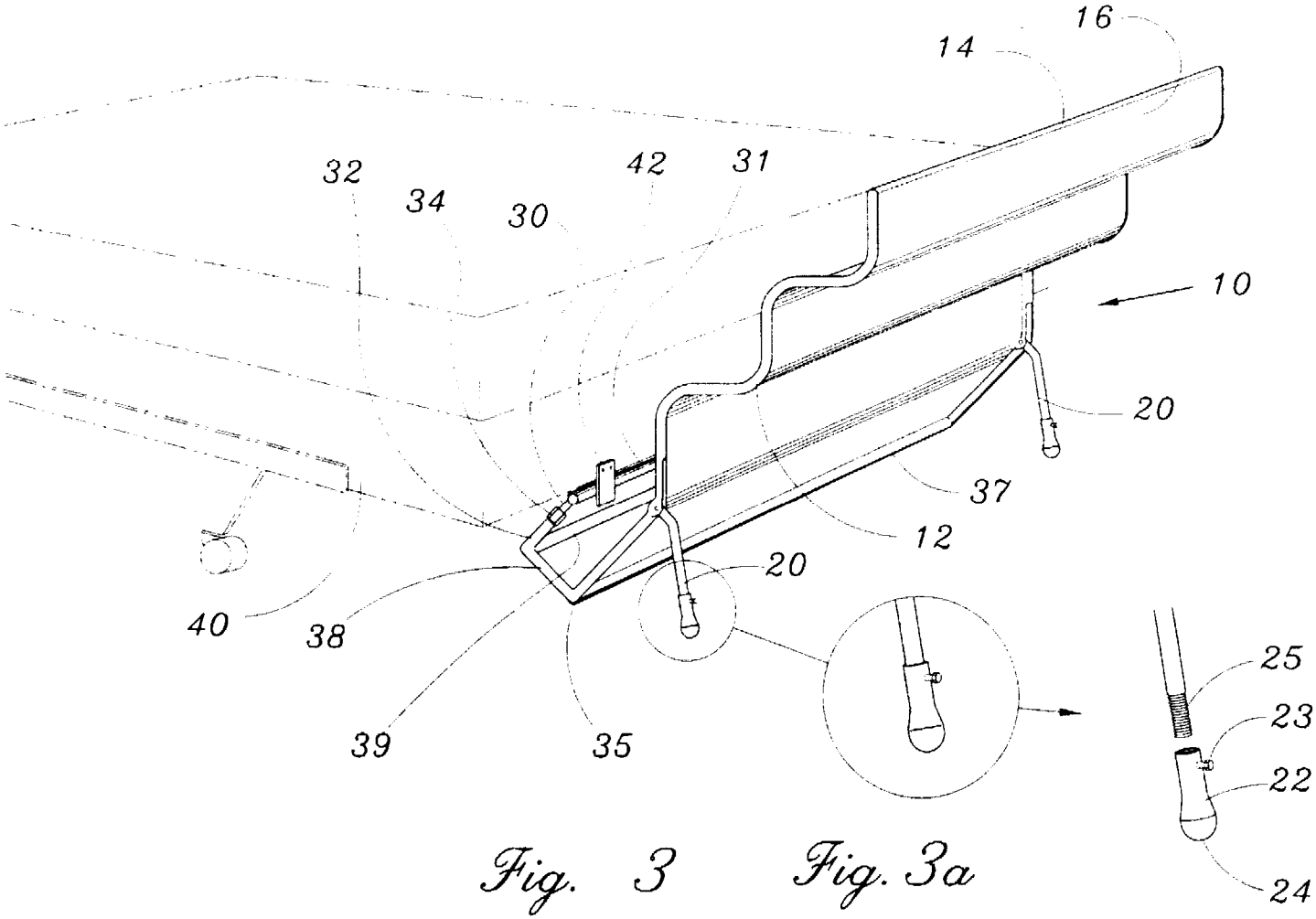
FIG. 3 of the drawings is a perspective view of the bedclothes storage surface of the present invention and the operation of the stabilizing and wedge assemblies as it is secured to the underside edge of a standard bed frame or foundation.
FIG. 3*a* of the drawings is an exploded view of the adjustable stabilization leg.
FIG. 3*b* of the drawings is break-away view showing the components of the adjustable stabilization leg.

Referring to FIGS. 3, 3*a* and 3*b*, the reverse surface of the portable bedclothes storage device (10) is shown, as are the first and second adjustable stabilizing legs (20) in the down or load bearing position. Slotted mechanically limiting cutouts of the tubular frame allow the legs to rotate, with regard to a reference established by the apparent vertical component of the first and second side support bars (12), from one hundred sixty two degrees of arc anti-clockwise for load support to minus thirty fifteen degrees of arc clockwise or within the envelope described by the undulating reverse side of the portable bedclothes storage device (10). This rotational capability allows the load bearing stabilization position and the stowage position of the legs to be established as well as a lodged position when resting the device on the first and second bottom wedge frame (38) of the wedge assembly for stand-alone convenience.

Continuing with FIG. 3, the adjustable stabilizing legs (20) are equipped with a threaded shaft and sleeve mechanism comprised of a threaded shaft (25), a threaded sleeve (22), a lock screw (23) and a rubberized friction pad (24). Adjustment is accomplished by rotating the threaded sleeve (22) clockwise or anti-clockwise to the desired length for effective storage of bed clothing. The lock screw (23) is then turned inward to lock the threaded sleeve (22) in position. A rubberized friction pad (24) is provided to the threaded shaft and sleeve mechanism to prevent unintentional slippage of the adjustable stabilizing legs (20) when in contact with the lower mounting plane, exemplified by the surface of a floor.

Figure 4:
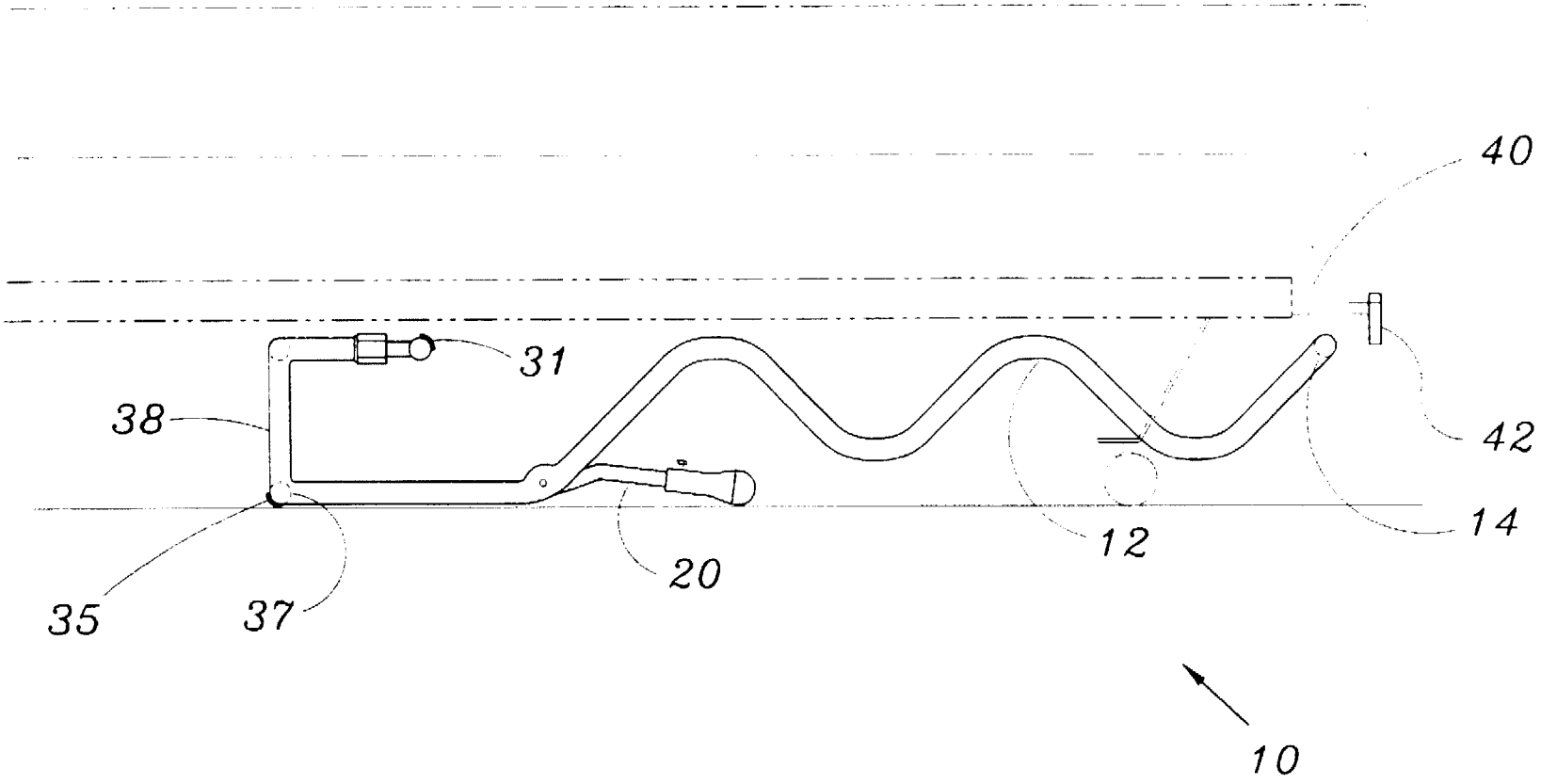
FIG. 4 of the drawings is a side view of the present invention in a stowed position underneath a bed.

Referring to FIG. 4, the portable bedclothes storage device (10) is shown in a stowed position between an elevated upper mounting plane and a lower mounting plane, in this instance, a bed without a footboard. The first and second alignment guide (42) controls and aligns withdrawal of the device, a function performed by a footboard should a bed be so equipped. In the stowed configuration, the portable bedclothes storage device (10) measures six and one half inches from the floor support to the extended curvature of the upper compression pad (31). A standard bed frame supporting a bed foundation measures seven and one half inches from the floor to the under surface of the foundation (40), providing a clearance of one inch between the upper compression pad (31) and the bottom of a bed foundation (40). When not compressed, the diagonal measurement between the extended curved surfaces of the upper compression pad (31) and the lower compression pad (35) is eight inches, allowing a compressible variance of one half inch when erected for use to receive and hold bed clothing as shown by FIG. 3.

A preferred embodiment of the present invention is described herein. It is to be understood, of course, that changes and modifications may be made in the embodiment without departing from the true scope and spirit of the present invention as defined by the appending claims.

That which is claimed is:

1. A portable bedclothes storage device embodied in a structural entity, comprising, in combination:

a. a bedclothes storage surface with a load bearing side and a reverse non-loading side being a sheeting of sturdy, resilient material supported in perimeter by an undulating frame, forming together with said bedclothes storage surface, a plurality of contoured retaining shelves, said frame having a top positioning bar, a first and second side support bar and a lower compression bar, said lower compression bar connecting said first and second side support bars at a lower mounting plane surface when said portable bedclothes storage device is erected to receive and hold items of storage;

b. an adjustable wedge assembly attached to said lower compression bar at said lower mounting plane such that said adjustable wedge assembly can be rotationally compressed between said lower mounting plane and an underside surface of an elevated upper mounting plane; and c. a first and second adjustable stabilizing leg assembly located between said reverse non-loading side of said bedclothes storage surface and said lower mounting plane forming a fulcrum to support a load bearing force applied to said bedclothes storage surface.

2. The portable bedclothes storage device as claimed in claim 1 wherein said adjustable wedge assembly comprises:

a. a first and second bottom wedge frame extending, in an orthogonal configuration, from both said lower compression bar and said first and second side support bars; and b. a first and second adjustable tube and socket assembly, said first adjustable tube and socket assembly being arranged parallel to said second adjustable tube and socket assembly and connected orthogonally to a compression pivot bar and an upper compression bar.

3. The portable bedclothes storage device as claimed in claim 2 wherein said upper compression bar of said adjustable wedge assembly can be extended or retracted to achieve an extension whereby said adjustable wedge assembly can achieve a desirable rotational compression between said lower mounting plane and said underside surface of said elevated upper mounting plane.

4. The portable bedclothes storage device as claimed in claim 2 wherein said first and second adjustable tube and socket assembly comprises:

a. a first and second split socket extending orthogonally from said compression pivot bar and said first and second bottom wedge frame away from a lower mounting plane when said bedclothes storage device is erected to receive and hold items of storage;

b. a first and second adjustable tube telescopically connected to said first and second split socket, said first and second adjustable tube having a first and second socket end and a first and second assemblage end, said first assemblage end being coextensively connected to said second assemblage end by said upper compression bar;

c. a first and second tapered cinch nut providing a means for locking said first and second adjustable tube inside said first and second split socket whereby a desired extension of said upper compression bar is achieved.

5. The portable bedclothes storage device as claimed in claim 2 wherein said upper compression bar of said adjustable wedge assembly is stopped during positioning of said portable bedclothes storage device by a plurality of alignment guides, said alignment guides extending downward just below said underside surface of said elevated upper mounting plane resting above said lower mounting plane.

6. The portable bedclothes storage device as claimed in claim 2 wherein said portable bedclothes storage device can be arranged to stand alone for upright stowage and portability by manually positioning said bedclothes storage device on said first and second bottom wedge frame, said lower compression bar and said compression pivot bar of said wedge assembly, while said first and second adjustable stabilizing leg assembly are manually placed to a fully rotated lodged position against said reverse non-loading side of said bedclothes storage surface.

7. The portable bedclothes storage device as claimed in claim 2 wherein said adjustable wedge assembly together with said first and second adjustable stabilizing leg assembly operate in combination to support said portable bedclothes storage device such that said bedclothes storage surface rises at an approximately forty-five degree angle from said lower mounting plane when erected to receive and hold items of storage, said adjustable wedge assembly together with said first and second adjustable stabilizing leg assembly being able to be released from an engaged position thereby enabling said portable bedclothes storage device to be laid flat beneath said elevated upper mounting plane support device or to be placed in a stand-alone upright position for convenience and portability.

8. The portable bedclothes storage device as claimed in claim 2 wherein said adjustable wedge assembly together with said first and second adjustable stabilizing leg assembly form a balanced equal and opposite pressure sensing and transference mechanism comprising a point of pivot of said first and second adjustable stabilizing leg assembly, a point of floor contact of said first and second adjustable stabilizing leg assembly, said lower compression bar and said upper compression bar, said balanced equal and opposite pressure sensing and transference mechanism forming a stabilized base of support for a projected loading platform when properly adjusted and compressed beneath a stationary lateral holding surface.

9. The portable bedclothes storage device as claimed in claim 1 wherein said adjustable stabilizing leg assembly comprises a first and second adjustable stabilizing leg of exact placement and angular projection pivoted within a guide slot of said first and second side support bar of said reverse non-loading side of said bedclothes storage surface to provide a brace between said bedclothes storage surface and a lower mounting plane when said bedclothes storage device is erected to receive and hold items of storage.

10. The portable bedclothes storage device as claimed in claim 9 wherein said first and second adjustable stabilizing legs are pivotally attached within said guide slots of said first and second side support bars such that said first and second adjustable stabilizing legs can freely pivot to a quiescent position of said reverse non-loading side of said bedclothes storage surface when said portable bedclothes storage device lies flat and when said portable bedclothes storage device is positioned upright.

11. The portable bedclothes storage device as claimed in claim 10 wherein said first and second stabilizing leg assembly can drop downward through force of gravity to a stabilizing brace position between said reverse non-loading side of said bedclothes storage surface and said lower mounting plane.

12. The portable bedclothes storage device as claimed in claim 9, wherein said first and second adjustable stabilizing legs can rotate to loosely lie on said reverse non-loading side of said bedclothes storage surface such that said portable bedclothes storage device can be arranged to lie flat beneath said elevated upper mounting plane, said lower mounting plane contacting said reverse non-loading side of said portable bedclothes storage device.

13. The portable bedclothes storage device as claimed in claim 1 wherein said bedclothes storage surface rises at approximately forty-five degrees with reference to said lower mounting plane when said bedclothes storage surface is erected for use to receive and hold items of storage.

14. The portable bedclothes storage device as claimed in claim 1 wherein said first and second adjustable stabilizing leg assembly is adjustable in length by means of a first and second threaded leg shaft encompassed by a first and second threaded sleeve and lock-screw mechanism so that said first and second adjustable stabilizing leg assembly can be extended or retracted by operation of said first and second threaded sleeve and lock-screw mechanism.

15. The portable bedclothes storage device as claimed in claim 14 wherein said first and second threaded sleeve of said first and second adjustable stabilizing leg assembly is provided with a rubberized pad on bottom contact surfaces to increase friction and to protect externally contacted surfaces.

16. The portable bedclothes storage device as claimed in claim 1 wherein said upper and lower compression bars are provided with a splined compression pad of rubberized composition attached lengthwise to said upper and lower compression bars whereby said compression pad provides protection and increases friction with externally contacted surfaces.

17. The portable bedclothes storage device as claimed in claim 1 wherein said adjustable wedge assembly and first and second stabilizing leg assembly are adjustable to adapt said bedclothes storage device for use between said lower mounting plane and said elevated upper mounting plane of various heights above said lower mounting plane and to adjust for uneven elevations between said lower mounting plane and said elevated upper mounting plane by extending or retracting said upper compression bar to effect a secure compression of said adjustable wedge assembly beneath said elevated upper mounting plane and by extending or retracting said first and second adjustable stabilizing leg assembly to provide a stabilized brace between said reverse non-loading side of said bedclothes storage surface and said lower mounting plane so that said portable bedclothes storage device can be erected to securely receive and hold items of storage.

18. The portable bedclothes storage device as claimed in claim 1 wherein said top positioning bar can be lifted upward such that said lower compression bar of said adjustable wedge assembly rotates to a wedged position against said lower mounting plane with said upper compression bar being compressed against said underside surface of said elevated upper mounting plane while said adjustable wedge assembly flexes about said compression pivot bar.

19. The portable bedclothes storage device as claimed in claim 1 wherein said top positioning bar of said bedclothes storage surface can be manipulated with a downward thrusting motion necessary for stowage of said portable bedclothes storage device beneath said elevated upper mounting plane whereby said lower compression bar of said adjustable wedge assembly releases a compressed grip at said lower mounting plane while said upper compression bar rotates downward and said first and second stabilizing leg assembly rotate and lie loosely against said reverse non-loading side of said portable bedclothes device to allow free clearance of said bedclothes storage device beneath said elevated upper mounted plane after manually pushing said top positioning bar inward sliding said portable bedclothes storage device beneath said elevated upper mounting plane.

* * * * *